US005298093A

United States Patent [19]

Okamoto

[11] Patent Number: 5,298,093

[45] Date of Patent: Mar. 29, 1994

[54] DUPLEX STAINLESS STEEL HAVING IMPROVED STRENGTH AND CORROSION RESISTANCE

[75] Inventor: Hiroshi Okamoto, Minoo, Japan

[73] Assignee: Sumitomo Metal Indusries, Ltd., Osaka, Japan

[21] Appl. No.: 974,231

[22] Filed: Nov. 10, 1992

[30] Foreign Application Priority Data

Nov. 11, 1991 [JP] Japan ..... 2-294016

[51] Int. Cl.[5] ..... C22C 38/44

[52] U.S. Cl. ..... 148/325; 148/327

[58] Field of Search ..... 148/325, 327; 420/67

[56] References Cited

U.S. PATENT DOCUMENTS 2,432,616 12/1947 Franks et al. .
2,432,617 12/1947 Franks et al. .
3,649,376 3/1972 Decroix .
4,500,351 2/1985 Bond et al. .
4,765,953 8/1988 Hagenfeldt et al. .

FOREIGN PATENT DOCUMENTS 0220141 4/1987 European Pat. Off. .
1466928 12/1966 France .
50-91516 7/1975 Japan .
52-716 1/1977 Japan .
56-142855 11/1981 Japan .
62-50444 3/1987 Japan .
62-180043 4/1990 Japan .
2-258956 10/1990 Japan .
2133037A 7/1984 United Kingdom .
2203680A 10/1988 United Kingdom .

*Primary Examiner*—Deborah Yee
*Attorney, Agent, or Firm*—Burns, Doane, Swecker & Mathis

[57] ABSTRACT

A duplex stainless steel has a chemical composition consisting essentially, on a weight basis, of: C: 0.03% or less, Si: 1.0% or less, Mn: 1.5% or less, P: 0.040% or less, S: 0.008% or less, sol.Al: 0.040% or less, Ni: 5.0–9.0%, Cr: 23.0–27.0%, Mo: 2.0–4.0%, N: 0.24–0.32%, W: greater than 1.5% and at most 5.0%, optionally at least one element selected from the group consisting of Cu: 0.2–2.0% and V: 0.05–1.5% and/or the group consisting of Ca: 0.02% or less, Mg: 0.02% or less, B: 0.02% or less, and one or more rare earth metals: 0.2% or less in total, and a balance of Fe and incidental impurities. The chemical composition has a value of at least 40 for PREW defined by the following formula (a):

$$PREW = [\%Cr] + 3.3([\%Mo] + 0.5[\%W]) + 16[\%N] \quad (a)$$

where the percent of each element is by weight. The steel exhibits high strength and excellent corrosion resistance which can be categorized as a super duplex stainless steel.

8 Claims, 1 Drawing Sheet

DUPLEX STAINLESS STEEL HAVING IMPROVED STRENGTH AND CORROSION RESISTANCE

BACKGROUND OF THE INVENTION

The present invention relates to a duplex stainless steel which has improved strength and corrosion resistance in chloride-containing environments and which is particularly suitable for use in applications where conventional duplex stainless steels may undergo corrosion such as in heat exchanger tubes, line pipes, and similar products, and in applications where high strength is required for reduction of material cost or weight.

Duplex (ferritic-austenitic) stainless steels have good corrosion resistance, particularly in sea water and they have been used for many years in various industrial equipment including heat exchanger tubes. Many attempts have also been made to improve duplex stainless steels, as proposed in Japanese Patent Applications Laid-Open Nos. 50-91516(1975), 52-716(1977), 56-142855(1981), 62-50444 (1987), 62-180043(1987), and 2-258956(1990).

In recent years, as the environments in which corrosion-resistant metallic materials are used become more severe, these materials are required to have higher levels of corrosion resistance and superior mechanical properties. Duplex stainless steels are no exception. In order to meet such requirements, the so-called super duplex stainless steels have recently been developed. For example, see U.S. Pat. No. 4,765,953; Vernhardsson, S., Corrosion 90, Apr. 23–27, 1990, Paper No. 164; and Lefebvre, G. et al, Proceedings of the First (1991) International Offshore and Polar Engineering Conference, pp. 224–232.

Pitting resistance equivalent (abbreviated as PRE or P.I.) of a duplex stainless steel which is defined by the following formula (b) is known as a parameter indicating resistance to localized corrosion, particularly to pitting corrosion:

$$PRE(\text{Pitting Resistance Equivalent}) = [\%\ Cr] + 3.3[\%\ Mo] + 16[\%\ N] \quad (b)$$

where the percent of each element is by weight.

In general, the Cr, Mo, and N contents of a duplex stainless steel are adjusted in such a manner that the steel has a PRE of 35 or higher. The super duplex stainless steels have a PRE above 40 by further increasing their Cr, Mo, and N contents and they are attracting interest as materials having excellent corrosion resistance, especially in sea water. The increased Cr, Mo, and N contents of super duplex stainless steels lead to an increase in strength. Therefore, the strength of super duplex stainless steels is even higher than conventional duplex stainless steels which inherently have a higher strength than ferritic or austenitic single-phase stainless steels, which is another prominent feature of super duplex stainless steels.

As described above, the basic concept of alloy designs for super duplex stainless steels, which surpass conventional duplex stainless steels in respect to corrosion resistance and strength, resides in increased contents of Cr, Mo, and N. However, when added in increased amounts, these elements give rise to the following problems.

The addition of Cr and Mo to a duplex stainless steel in increased amounts tends to cause the formation of hard and brittle intermetallic compounds called $\sigma$-phase, $\chi$-phase, Laves phase, and the like (hereinafter referred to as $\sigma$- and similar phases). As a result, the steel becomes difficult to work and flaws and cracks may be formed during working, thereby making it difficult to industrially manufacture steel products such as tubes in a stable manner. An excessive increase in the N content causes a deterioration in mechanical properties due to the formation of nitrides and generation of blowholes. Furthermore, when a duplex stainless steel having increased Cr and Mo contents is welded, intermetallic compounds ($\sigma$- and similar phases) are precipitated in the steel by the effect of heat generated during welding, resulting in a deterioration in not only corrosion resistance but also in mechanical properties such as toughness and ductility in heat affected zones. Since the thermal structural stability of the steel is degraded in this manner, strict control of heat input during welding and heat treatment after welding are necessary in order to avoid such degradation, leading to a decrease in operating efficiency when steel tubes or other products made of the steel are installed.

SUMMARY OF THE INVENTION

It is an object of the invention to provide a duplex stainless steel which has high strength and excellent corrosion resistance comparable or even superior to the prior art super duplex stainless steels and which is less susceptible to precipitation of intermetallic compounds of $\sigma$- and similar phases.

The invention provides a duplex stainless steel which is improved in thermal structural stability and which is less susceptible to sensitization and embrittlement during normal welding and stress-relief (SR) heat treatment.

In brief, the present invention is a high-strength duplex stainless steel having improved corrosion resistance, which has a chemical composition consisting essentially, on a weight basis, of:

| | |
|---|---|
| C: 0.03% or less, | Si: 1.0% or less, |
| Mn: 1.5% or less, | P: 0.040% or less, |
| S: 0.008% or less, | sol.Al: 0.040% or less, |
| Ni: 5.0–9.0%, | Cr: 23.0–27.0%, |
| Mo: 2.0–4.0%, | N: 0.24–0.32%, |
| W: greater than 1.5% and at most 5.0%, | |

optionally one or more elements selected from the first group consisting of Cu: 0.2–2.0% and V: 0.05–1.5% and/or the second group consisting of Ca: 0.02% or less, Mg: 0.02% or less, B: 0.02% or less, and one or more rare earth metals: 0.2% or less in total, and a balance of Fe and incidental impurities, the chemical composition having a value of at least 40 for PREW defined by the following formula (a):

$$PREW = [\%Cr] + 3.3([\%Mo] + 0.5[\%W]) + 16[\%N] \quad (a)$$

where the percent of each element is by weight.

DETAILED DESCRIPTION OF THE INVENTION

Figure 1:
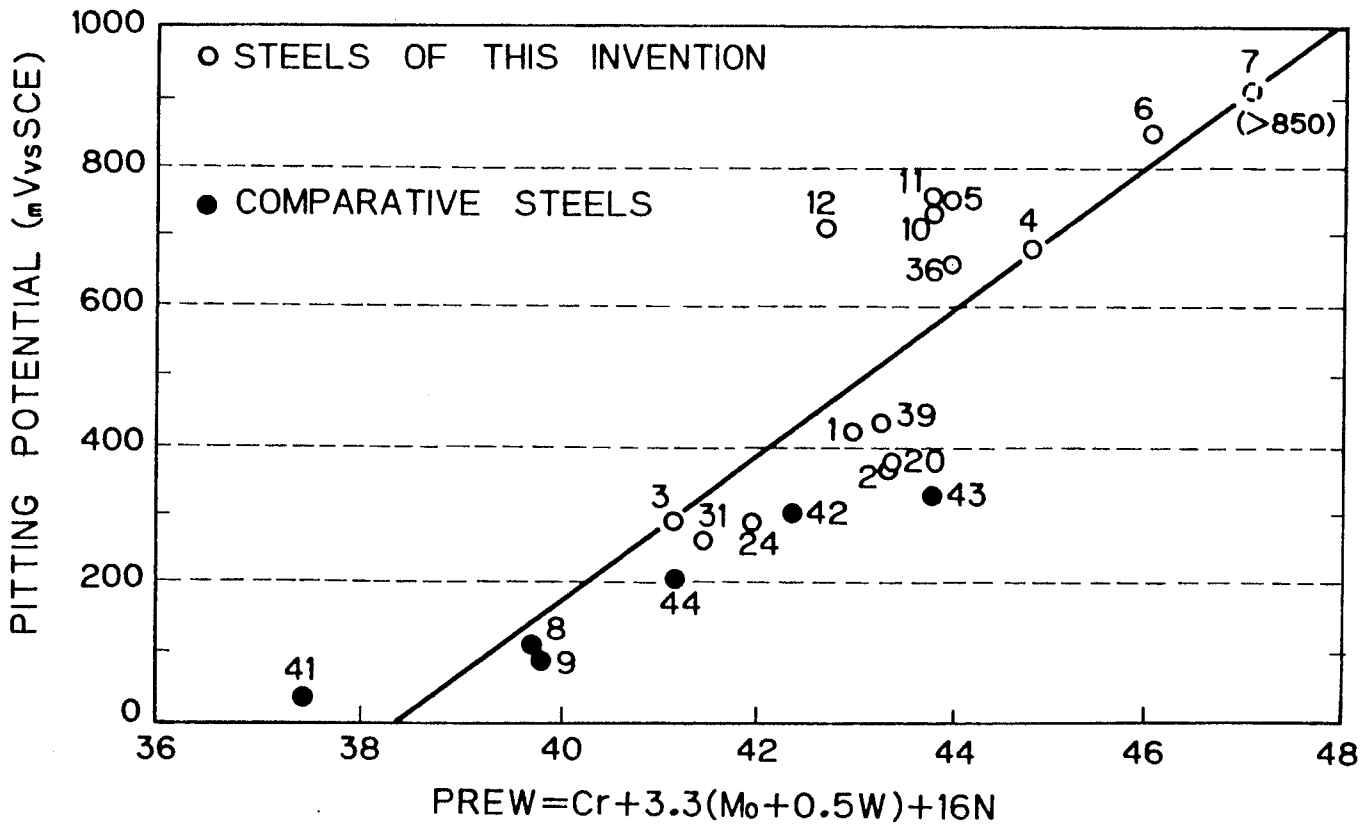
FIG. 1 is a plot of pitting potential of the steels tested in the Example as a function of PREW values thereof in which the pitting potential was measured in an aqueous 20% NaCl solution at 80° C.

The duplex stainless steel of the present invention has high strength and exhibits excellent corrosion resistance comparable to or even superior to the prior art super duplex stainless steels. Nevertheless, it does not suffer the above-mentioned problems of the super duplex stainless steels. Namely, it has improved thermal structural stability and is less susceptible to precipitation of intermetallic compounds ($\sigma$- and similar phases) during alloy preparation, hot working, heat treatment, and welding. These desirable properties of the duplex stainless steel of the present invention are attained as the overall effect of the above-described many alloying elements. However, the most prominent feature of the alloy composition resides in addition of W in an increased amount.

As described previously, in order to improve the corrosion resistance of a duplex stainless steel by increasing the value of PRE defined by the foregoing formula (b), it is effective to increase the contents of Cr and Mo. However, these elements have an adverse effect of promoting the formation of intermetallic compounds ($\sigma$- and similar phases). It is considered that the following formula (c) for phase stability index (PSI) is usually effective for eliminating such adverse effects:

$$PSI(\text{Phase Stability Index}) = [\%\ Cr] + 3.3[\%\ Mo] + 3[\%\ Si] \leqq 40 \quad (c)$$

The maximum value of 40 for PSI is the threshold value for eliminating the formation of $\sigma$- and similar phases under heating conditions for hot rolling, heat treatment (solution treatment) conditions, and welding conditions which are normally applied to such a stainless steel. Therefore, in order to avoid the formation of $\sigma$- and similar phases, it is a common knowledge to select the contents of Cr, Mo, and Si so that the PSI value does not exceed the threshold value of 40.

Tungsten (W) is generally considered as an alloying element having the same effects as Mo and it is frequently dealt with such that a content of Mo (in weight percent) and its half content of W are equivalent to each other. According to this common knowledge, when W is added to a duplex stainless steel, the foregoing formula (c) for PSI must be modified by adding approximately "1.5[%W]" to the formula. Thus, the total contents of Cr, Mo, Si, and W are regulated so as to satisfy formula (c) and the addition of W must be accompanied by a corresponding decrease in the contents of the other elements. Accordingly, preferential addition of W, which is an expensive metal, is of little significance. For this reason, even though W is added, the W content is restricted to at most 1.5% by weight in most conventional duplex stainless steels.

In this respect, the afore-mentioned Japanese Patent Applications Laid-Open Nos. 56-142855(1981) and 62-180043(1987) indicate in the claims that the W content is up to 2.0% by weight. However, the W contents actually employed in the steels which are specifically disclosed in these applications are limited to be as low as 0.2–0.3% by weight.

The present inventor thoroughly investigated the effects of W in duplex stainless steels and found that W contributes to PRE defined by formula (b) or resistance to corrosion, particularly pitting corrosion, but its effect on PSI defined by formula (c) or formation of $\sigma$- and similar phases is negligible, which is an unexpected finding in contradiction to the above-described common knowledge. Thus, W has no substantial effect on hardening of these steels when they are heat-treated or affected by heat in a temperature range of 850°–900° C., at which precipitation of $\sigma$- and similar phases is readily initiated. In other words, like Mo, W is effective for improvement in corrosion resistance and particularly resistance to pitting corrosion but, unlike Mo, W causes little acceleration of the formation of $\sigma$- and similar phases.

It is estimated that the reason why W has little effect on acceleration of the formation of $\sigma$- and similar phases is because the rate of diffusion of W in a relatively low temperature range of 850°–900° C. is low due to its atomic weight, which is nearly double the atomic weight of Mo.

Based on this finding, W is positively added in the duplex stainless steel according to this invention and a new formula for PRE in which the W content is included and which is abbreviated as PREW is determined as follows.

$$PREW = [\%Cr] + 3.3([\%Mo] + 0.5[\%W]) + 16[\%N] \quad (a)$$

The reasons for restricting the chemical composition of the duplex stainless steel of the present invention will now be described. In the following description, all percents are by weight unless otherwise indicated.

Carbon (C)

Carbon is effective for stabilizing austenitic phases, as is N. However, the presence of carbon in an amount greater than 0.03% tends to cause precipitation of carbides, resulting in a deterioration in corrosion resistance. Therefore, the carbon content is 0.03% or less.

Silicon (Si)

Silicon is effective as a deoxidizer but it has an adverse effect that it accelerates the formation of intermetallic compounds ($\sigma$- and similar phases), as can be seen from formula (c). In view of this effect of Si, the Si content is restricted to 1.0% or less. Preferably, the Si content is at most 0.5%.

Manganese (Mn)

Manganese has a desulfurizing and deoxidizing effect during melting of duplex stainless steels and serves to improve hot workability of the steels. Another desirable effect of Mn is to increase the solubility of N. Because of these effects of Mn, up to 2% of Mn content is allowed in most conventional duplex stainless steels. However, since Mn has the effect of deteriorating corrosion resistance through the formation of MnS, the Mn content is restricted to 1.5% or less in the present invention. Preferably, the Mn content is at most 1.5%.

Phosphorus (P)

Phosphorus is an impurity element incidentally incorporated in the steel. The P content is restricted to 0.040% or less since corrosion resistance and toughness are remarkably degraded with a P content of more than 0.040%. Preferably, the P content is 0.030% or less.

Sulfur (S)

Sulfur is also an impurity element incidentally incorporated in the steel. It adversely affects the hot workability of the steel due to the formation of sulfides, which are segregated on the grain boundaries. The sulfides serve as points at which pitting corrosion is initiated, thereby degrading resistance to pitting corrosion. In order to minimize these adverse effects of S, the S content is restricted to 0.008% or less. The S content should be as low as possible and desirably it is 0.005% or less.

Soluble Aluminum (sol.Al)

Aluminum is effective as a deoxidizer. However, when the steel has a relatively high N content as in the present invention, the addition of an excess amount of aluminum causes precipitation of aluminum nitride (AlN), which is undesirable for the steel structure and leads to a loss of corrosion resistance and toughness. Therefore, the Al content is restricted to 0.040% or less as sol.Al.

In the melting of the steel of the present invention, the deoxidizer required for refining is comprised predominantly of Al, since the addition of Si in a large amount is avoided in the invention. However, when vacuum melting is employed, the addition of Al is not always necessary.

Nickel (Ni)

Nickel is an essential element for stabilizing austenitic phases. However, when the Ni content exceeds 9.0%, the content of ferritic phases is so decreased that it is difficult for steel to exhibit the basic properties characteristic of duplex stainless steels, and it is susceptible to precipitation of intermetallic compounds ($\sigma$- and similar phases). The properties characteristic of duplex stainless steels are also lost at a Ni content of less than 5.0%, since the content of ferritic phases is excessively increased. In addition, due to a low solubility of N in ferritic phases, nitrides tend to precipitate at such a low Ni content, leading to a degradation of corrosion resistance. Therefore, the Ni content is 5.0–9.0% and preferably 6.0–8.0%.

Chromium (Cr)

Chromium is an essential element effective for maintaining corrosion resistance. When the Cr content is less than 23.0%, an improved level of corrosion resistance suitable for a super duplex stainless steel cannot be attained. On the other hand, at a Cr content exceeding 27.0%, precipitation of intermetallic compounds ($\sigma$- and similar phases) becomes significant, leading to a deterioration in hot workability and weldability. Therefore, the Cr content is 23.0–27.0% and preferably 24.0–26.0%.

Molybdenum (Mo)

Like Cr, molybdenum contributes to formula (a) and it is very effective for improving corrosion resistance, particularly resistance to pitting corrosion and crevice corrosion. A Mo content of at least 2.0% is required to assure that the resulting steel has substantially improved corrosion resistance. However, the addition of Mo in an excessively large amount causes embrittlement of the steel in the preparation thereof. Furthermore, like Cr, it has the undesirable effect of increasing the PSI value of formula (c), thereby facilitating precipitation of intermetallic compounds. Therefore, the Mo content is 4.0% at most. Preferably, the Mo content is 2.5–3.5%.

Tungsten (W)

As described above, the addition of tungsten in a relatively large amount is the most prominent feature of the duplex stainless steel of the present invention. Like Mo, W has an effect of improving corrosion resistance, particularly resistance to pitting corrosion and crevice corrosion. In particular, W can form a stable oxide which serves to improve corrosion resistance in low-pH environments.

However, W is more expensive than Mo and its atomic weight is nearly double the atomic weight of Mo, indicating that the amount of W required to attain the same effect as Mo is twice as large as the amount of Mo. In addition, W was considered to have an adverse effect of accelerating the formation of intermetallic compounds ($\sigma$- and similar phases) like Mo. For these reasons, W has not been positively added in a large amount.

In accordance with the present invention, on the basis of the above-described finding, W is added in an amount of greater than 1.5%. When the W content is 1.5% or less, the contents of Cr, Mo, and N must be increased in order to guarantee that the value for PREW defined by formula (a) is at least 40, thereby adversely affecting the hot workability and thermal structural stability of the steel. The contents of Mo and Cr can be decreased with increasing W content, making it possible to minimize the adverse effect of these elements that accelerate the formation of $\sigma$- and similar phases. For this reason, it is desirable that W be added in an amount of greater than 2.0%. The addition of W in excess of 5.0% does not provide the steel with further improvement in properties. Therefore, the W content is up to 5.0%. Preferably, the W content is greater than 2.0% and not greater than 3.0%.

Nitrogen (N)

Like Ni, nitrogen is an effective austenite former and serves to improve thermal stability and corrosion resistance of duplex stainless steels. In the steel of the present invention in which Cr and Mo, both ferrite formers, are added in large amounts, N is positively added in an amount of at least 0.24% in order to assure a proper balance of the duplex phases (austenitic and ferritic phases).

In addition, N serves to improve corrosion resistance of the steel by contributing to PREW defined by formula (a), as do Cr, Mo, and W. However, in 25% Cr-type duplex stainless steels as in the present invention, the addition of N in excess of 0.32% degrades the toughness andcorrosion resistance of the steels due to the formation of defects caused by generation of blowholes or due to the formation of nitrides in heat-affected zones during welding. Therefore, the N content is 0.24–0.32%.

Value for PREW

The contents of Cr, Mo, W, and N which are described above are further restricted in such a manner that the value for PREW defined by formula (a) is at least 40. The formula for PREW, i.e., PREW $=[\%Cr]+3.3([\%Mo]+0.5[\%W])+16[\%N]$, is derived by adding the effect of W to the known formula (b) for PRE. The same formula is already disclosed in the afore-mentioned Japanese Patent Application Laid-Open No. 62-50444(1987) as P.I. However, this Japanese application merely defines as P.I.$\geqq$32.5. It is not suggested in the application at all that when the value for the formula is over 40, the corrosion resistance is remarkably improved and the strength is further increased nor that W does not affect the formula for PSI, i.e., formula (c) and therefore can be added in an increased amount.

In addition to the above-described alloying elements, the duplex stainless steel of the present invention may further comprise one or more elements selected from the following first and second groups as optional alloying elements.

First Group Optional Elements (Cu, V)

Copper (Cu) and vanadium (V) are equivalent to each other in the duplex stainless steel of the present invention in that they have a common effect of improving the corrosion resistance of the steel, particularly its resistance to non-oxidizing acids such as sulfuric acid.

More specifically, Cu is particularly effective for improving the corrosion resistance in a reducing low-pH environment such as in $H_2SO_4$ or in an $H_2S$-containing environment. This effect is appreciable when the Cu content is 0.2% or more. However, the addition of Cu in excess of 2.0% causes a deterioration in hot workability of the steel. Therefore, when added, Cu is present in the steel in an amount of 0.2–2.0% and preferably 0.2–0.8%.

The addition of V in an amount of at least 0.05% in combination with W is effective for improving the resistance to crevice corrosion of the steel. The upper limit of the V content is 1.5% since the addition of V in a larger amount undesirably increases the proportion of ferritic phases, resulting in a decrease in toughness and corrosion resistance. Thus, when added, V is present in an amount of 0.05–1.5% and preferably 0.05–0.5%.

Second Optional Element Group (Ca, Mg, B, REM)

Calcium (Ca), magnesium (Mg), boron (B), and rare earth metals (REM) all serve to improve the hot workability of the steel by fixing sulfur or oxygen. The duplex stainless steel of the present invention has good hot workability in itself due to a low S content and the nature of W, which does not serve to accelerate the formation of $\sigma$- and similar phases although added in a large amount.

However, when the steel is worked to fabricate it into products with a high reduction in area through forging, rolling, extrusion, or a similar working process, it is desired that the steel have further improved hot workability. In such cases, one or more elements selected from the second group may be added, as required.

The duplex stainless steel of the present invention can be used in the form of castings, or it can be fabricated in the form of a powder to manufacture products such as tube and pipes by hot pressing and/or sintering using powder metallurgy techniques. When these fabrication processes are employed, the hot workability of the steel is of little consideration and it is generally unnecessary to add the second group elements.

When one or more elements selected from the second group are added, the addition of excessive amounts of these elements results in the formation of oxides and sulfides of these elements in increased amounts, leading to a deterioration in corrosion resistance, since nonmetallic inclusions such as oxides and sulfides serve as points at which pitting corrosion is initiated. Therefore, it is preferred that the content of each of Ca, Mg, and B be at most 0.02% and the content of REM (mainly La and/or Ce) be at most 0.2% in total when added. The lower limit of each of these elements is preferably equal to or higher than the arithmetic sum of the contents of impurities, S and O($[\%S]+\frac{1}{2}[\%O]$).

Preferably, the content of ferritic phases in the duplex stainless steel of the present invention is 35–55 vol % in the as-annealed or heat-treated condition.

The duplex stainless steel can be prepared in a conventional manner by preparing a melt having the desired alloy composition and casting to form an ingot. Alternatively, the melt may be subjected to atomization such as argon or nitrogen gas atomization to form a powder of the steel.

The duplex stainless steel of the present invention is a high-strength steel having corrosion resistance far superior to that of conventional duplex stainless steels which are now employed in various industrial applications. It can be classified as a super duplex stainless steel and can withstand more severe corrosive environments than conventional duplex stainless steels. Therefore, it can be used in severely corrosive environments and it is also useful in the manufacture of thin, lightweight products in view of its high strength. Specifically, the duplex stainless steel is suitable for use in the manufacture of installations, equipment, and instruments used in seawater environments as well as installations and tubing used in drilling and transportation of petroleum and natural gas.

The duplex stainless steel has enhanced thermal structural stability and is less susceptible to hardening and embrittlement caused by precipitation of intermetallic compounds during hot working or welding. Therefore, working can be readily performed on the steel and welding can also be applied thereto in the manufacture and installation of the above-described products.

The following examples are presented to further illustrate the present invention. These examples are to be considered in all respects as illustrative and not restrictive.

EXAMPLE

Duplex stainless steels having the chemical compositions shown in Table 1 were prepared by melting in a 20 kg vacuum melting furnace and they were cast into ingots. The ingots were heated at 1200° C. and forged into a thickness of 15 mm. Each of the resulting forged plates was then subjected to solution treatment at 1100° C. for 30 minutes and machined to prepare prescribed test specimens for use in the following tests to evaluate corrosion resistance and other properties.

1) Pitting Potential

The test specimen used was a disc measuring 15 mm in and 2 mm in thickness and it was sealed so as to leave an area of 1 $cm^2$ as the area to be measured. The sealed test specimen was then immersed in an aqueous 20% NaCl solution at 80° C. and its pitting potential was measured according to JIS G 0579.

2) Weight Loss by Pitting Corrosion

A test specimen measuring 10 mm (w)×3 mm (t)×40 mm (l) was immersed for 24 hours in an aqueous 10% $FeCl_3.6H_2O$ solution at 50° C. The same immersion test was also conducted at 75° C. After the immersion, the weight loss of the test specimen was measured to determine the corrosion rate.

3) Corrosion Resistance in Acid

A test specimen measuring 10 mm (w)×3 mm (t)×40 mm (l) was immersed in a boiling 10% $H_2SO_4$ solution for 3 hours and the weight loss was then measured to determine the corrosion rate.

4) Thermal Structural Stability

From the test material which had been subjected to the above-described solution treatment, a test specimen measuring 12 mm (t)×25 mm (w)×40 mm (l) was cut and subjected to aging treatment at 850° C. for 10 minutes followed by water cooling. Another test specimen of the same dimensions was subjected to aging treatment at 900° C. for 10 minutes followed by water cooling. The hardness of each test specimen was measured using a Vickers hardness tester before and after the aging treatment. The amount of intermetallic compounds precipitated by the aging treatment was evaluated by the increment of Vickers hardness (ΔHv) after the aging treatment.

5) Hot Workability

A test bar having a diameter of 10 mm and a length of 200 mm was heated at 1000 ° C for 3 minutes using a simulating heat-affected zone tester. Immediately after the heating, a tensile force was applied to the test bar at a speed of 300 mm/sec and the reduction of area at fracture was measured.

6) Mechanical Properties

Using test specimens having the shape prescribed as No. 10 Test Specimen in JIS Z 2201, a tensile test was performed at room temperature (RT) and at 200° C.

The test results except for mechanical properties are summarized in Table 2. Also included in Table 2 are values for phase stability index (PSI) and PRE defined by formulas (c) and (a), respectively, of each test material. The test results of mechanical properties are shown in Table 3.

In Tables 1 to 3, Steels Nos. 42 to 44 are conventional steels which correspond to the prior art super duplex stainless steels disclosed in U.S. Pat. No. 4,765,953.

TABLE 1

| | | Chemical Composition | | | | | | | | | | | (wt %, Fe: balance) | |
|---|---|---|---|---|---|---|---|---|---|---|---|---|---|---|
| No. | | C | Si | Mn | P | S | Ni | Cr | Mo | W | N | sol.Al | First Group | Second Group |
| 1 | ○ | 0.010 | 0.28 | 0.47 | 0.016 | 0.002 | 7.05 | 25.00 | 3.48 | 1.63 | 0.241 | 0.022 | | |
| 2 | ○ | 0.019 | 0.31 | 0.52 | 0.025 | 0.001 | 7.20 | 24.90 | 3.39 | 1.90 | 0.261 | 0.020 | | |
| 3 | ○ | 0.014 | 0.28 | 0.49 | 0.021 | 0.002 | 7.05 | 23.50 | 3.09 | 1.90 | 0.272 | 0.021 | | |
| 4 | ○ | 0.011 | 0.29 | 0.47 | 0.015 | 0.002 | 7.15 | 25.15 | 3.49 | 2.40 | 0.261 | 0.017 | | |
| 5 | ○ | 0.014 | 0.28 | 0.49 | 0.020 | 0.002 | 7.20 | 24.95 | 3.06 | 3.15 | 0.255 | 0.011 | | |
| 6 | ○ | 0.015 | 0.30 | 0.50 | 0.023 | 0.001 | 7.45 | 24.90 | 3.22 | 3.90 | 0.258 | 0.021 | | |
| 7 | ○ | 0.017 | 0.32 | 0.57 | 0.022 | 0.002 | 6.50 | 24.42 | 3.17 | 4.83 | 0.265 | 0.028 | | |
| 8 | x | 0.020 | 0.35 | 0.61 | 0.027 | 0.001 | 6.89 | 24.42 | 3.01 | 0.91* | 0.243 | 0.015 | | |
| 9 | x | 0.021 | 0.33 | 0.52 | 0.026 | 0.002 | 7.09 | 25.52 | 2.50 | 1.62 | 0.262 | 0.013 | | |
| 10 | ○ | 0.015 | 0.27 | 0.49 | 0.021 | 0.002 | 7.25 | 25.13 | 3.22 | 2.21 | 0.273 | 0.005 | Cu = 0.51 | |
| 11 | ○ | 0.022 | 0.38 | 0.55 | 0.023 | 0.001 | 7.02 | 24.75 | 3.31 | 2.39 | 0.263 | 0.003 | V = 0.11 | |
| 12 | ○ | 0.013 | 0.27 | 0.49 | 0.017 | 0.002 | 6.73 | 24.59 | 3.12 | 2.27 | 0.259 | 0.005 | Cu = 1.21, V = 1.09 | |
| 13 | x | 0.021 | 0.31 | 0.54 | 0.021 | 0.005 | 6.82 | 25.72 | 3.21 | 2.48 | 0.282 | 0.002 | Cu = 3.12* | |
| 14 | x | 0.027 | 0.52 | 0.55 | 0.025 | 0.005 | 7.85 | 25.51 | 3.01 | 2.10 | 0.274 | 0.004 | V = 3.01* | |
| 15 | x | 0.025 | 0.52 | 0.62 | 0.027 | 0.004 | 7.85 | 25.48 | 3.07 | 2.09 | 0.279 | 0.003 | Cu = 2.53*, V = 1.78* | |
| 16 | ○ | 0.019 | 0.42 | 0.71 | 0.015 | 0.005 | 6.52 | 24.42 | 2.89 | 2.21 | 0.251 | 0.025 | | Ca = 0.018 |
| 17 | ○ | 0.022 | 0.37 | 0.70 | 0.017 | 0.003 | 6.77 | 24.49 | 3.02 | 2.20 | 0.263 | 0.027 | | Mg = 0.012 |
| 18 | ○ | 0.020 | 0.39 | 0.60 | 0.016 | 0.003 | 6.59 | 24.25 | 3.21 | 2.10 | 0.261 | 0.022 | | B = 0.009 |
| 19 | ○ | 0.017 | 0.41 | 0.62 | 0.017 | 0.006 | 6.51 | 24.22 | 3.17 | 2.35 | 0.275 | 0.021 | | REM = 0.05 |
| 20 | ○ | 0.024 | 0.42 | 0.65 | 0.020 | 0.007 | 6.63 | 24.33 | 3.31 | 2.42 | 0.255 | 0.021 | | Ca = 0.012, Mg = 0.009 |
| 21 | ○ | 0.018 | 0.44 | 0.70 | 0.017 | 0.005 | 6.60 | 24.52 | 2.95 | 2.15 | 0.270 | 0.025 | | Ca = 0.015, B = 0.008 |
| 22 | ○ | 0.017 | 0.39 | 0.63 | 0.023 | 0.008 | 6.51 | 24.51 | 3.30 | 2.30 | 0.267 | 0.022 | | Ca = 0.011, REM = 0.12 |
| 23 | ○ | 0.023 | 0.43 | 0.65 | 0.022 | 0.005 | 6.72 | 24.50 | 3.15 | 2.02 | 0.272 | 0.019 | | Mg = 0.012, B = 0.003 |
| 24 | ○ | 0.012 | 0.43 | 0.66 | 0.025 | 0.007 | 6.81 | 24.37 | 3.07 | 2.13 | 0.250 | 0.005 | | Mg = 0.010, REM = 0.05 |
| 25 | ○ | 0.013 | 0.40 | 0.63 | 0.021 | 0.004 | 7.03 | 24.42 | 3.33 | 2.22 | 0.273 | 0.004 | | B = 0.008, REM = 0.04 |
| 26 | x | 0.018 | 0.35 | 0.69 | 0.019 | 0.001 | 7.25 | 24.15 | 2.90 | 2.42 | 0.242 | 0.005 | | Ca = 0.032* |
| 27 | x | 0.021 | 0.42 | 0.70 | 0.019 | 0.003 | 6.38 | 24.57 | 2.85 | 2.05 | 0.255 | 0.003 | | Mg = 0.029* |
| 28 | x | 0.022 | 0.44 | 0.71 | 0.018 | 0.002 | 7.25 | 24.48 | 2.77 | 2.23 | 0.260 | 0.002 | | B = 0.024* |
| 29 | x | 0.025 | 0.41 | 0.72 | 0.017 | 0.005 | 7.21 | 24.61 | 2.80 | 2.17 | 0.281 | 0.007 | | REM = 0.23* |
| 30 | x | 0.023 | 0.44 | 0.65 | 0.021 | 0.005 | 6.89 | 25.12 | 2.91 | 2.10 | 0.261 | 0.010 | | Ca = 0.039*, Mg = 0.023* |
| 31 | ○ | 0.016 | 0.47 | 0.52 | 0.021 | 0.001 | 6.65 | 24.23 | 2.78 | 2.03 | 0.295 | 0.016 | Cu = 0.52 | Ca = 0.004 |
| 32 | ○ | 0.019 | 0.45 | 0.55 | 0.019 | 0.002 | 6.82 | 24.37 | 2.65 | 2.51 | 0.303 | 0.020 | Cu = 0.51 | B = 0.007 |
| 33 | ○ | 0.015 | 0.72 | 0.48 | 0.022 | 0.001 | 6.91 | 24.42 | 2.75 | 2.60 | 0.291 | 0.017 | Cu = 1.17, V = 0.91 | Ca = 0.009 |
| 34 | ○ | 0.017 | 0.65 | 0.61 | 0.017 | 0.001 | 7.02 | 24.21 | 2.83 | 2.45 | 0.285 | 0.022 | Cu = 1.16, V = 0.87 | B = 0.010 |
| 35 | ○ | 0.022 | 0.68 | 0.60 | 0.015 | 0.001 | 6.93 | 23.95 | 3.49 | 2.07 | 0.258 | 0.025 | V = 0.12 | REM = 0.01 |
| 36 | ○ | 0.025 | 0.60 | 0.58 | 0.013 | 0.002 | 7.02 | 23.51 | 3.61 | 2.22 | 0.307 | 0.024 | V = 0.11 | Ca = 0.011 |
| 37 | ○ | 0.021 | 0.59 | 0.53 | 0.018 | 0.001 | 7.23 | 25.67 | 3.11 | 2.35 | 0.252 | 0.018 | V = 1.48 | REM = 0.03 |
| 38 | ○ | 0.015 | 0.63 | 0.51 | 0.021 | 0.002 | 7.85 | 26.05 | 2.92 | 2.41 | 0.269 | 0.019 | Cu = 0.35, V = 0.88 | Mg = 0.009 |
| 39 | ○ | 0.011 | 0.61 | 0.52 | 0.022 | 0.002 | 8.23 | 25.12 | 3.03 | 2.20 | 0.285 | 0.023 | Cu = 1.12, V = 0.12 | Ca = 0.005 |
| 40 | ○ | 0.013 | 0.58 | 0.57 | 0.025 | 0.001 | 7.05 | 26.38 | 2.47 | 2.19 | 0.272 | 0.045 | Cu = 1.09, V = 0.85 | REM = 0.02 |
| 41 | x | 0.019 | 0.59 | 0.61 | 0.023 | 0.001 | 7.05 | 24.75 | 3.14 | 0.21* | 0.128* | 0.017 | Cu = 0.51 | Ca = 0.003 |
| 42 | x | 0.019 | 0.28 | 0.47 | 0.019 | 0.002 | 6.90 | 25.00 | 3.95 | 0.05* | 0.268 | 0.024 | | |
| 43 | x | 0.015 | 0.28 | 0.49 | 0.023 | 0.002 | 7.05 | 25.90 | 3.94 | 0.20* | 0.283 | 0.025 | | Ca = 0.005 |

TABLE 1-continued

| No. | | Chemical Composition C | Si | Mn | P | S | Ni | Cr | Mo | W | N | sol.Al | (wt %, Fe: balance) First Group | Second Group |
|---|---|---|---|---|---|---|---|---|---|---|---|---|---|---|
| 44 | x | 0.017 | 0.71 | 0.51 | 0.015 | 0.003 | 7.62 | 25.07 | 3.52 | 0.71* | 0.211 | 0.023 | Cu = 0.49 | |

Note
○: Present Invention,
x: Comparative.
*: Outside the range defined in the present invention.

TABLE 2

| No. | 1) | PSI2) | PREW3) | Hardening after ageing (ΔHv) at 850° C. | at 900° C. | Pitting potential (mVvsSCE) | Corrosion rate in 10% $FeCl_3$(g/m²-hr) at 50° C. | at 75° C. | Corrosion rate in $H_2SO_4$ (g/m²-hr) | Hot workability (% Reduction in area) |
|---|---|---|---|---|---|---|---|---|---|---|
| 1 | ○ | 37.3 | 43.0 | — | 66 | 415 | <0.02 | 0.15 | 1.13 | 84 |
| 2 | ○ | 37.0 | 43.4 | 4 | 32 | 373 | " | 0.05 | 1.12 | 82 |
| 3 | ○ | 34.5 | 41.2 | 1 | 33 | 285 | " | 0.85 | 1.21 | 82 |
| 4 | ○ | 37.5 | 44.8 | — | 57 | 673 | " | <0.02 | 1.15 | 80 |
| 5 | ○ | 35.9 | 44.3 | 9 | 42 | 747 | " | " | 1.09 | 78 |
| 6 | ○ | 36.4 | 46.1 | 1 | 46 | 847 | " | " | 1.12 | 74 |
| 7 | ○ | 35.8 | 47.1 | — | 49 | >850[4] | " | " | 1.07 | 74 |
| 8 | x | 35.4 | 39.7* | 3 | 45 | 105 | 0.07 | 1.89 | 1.19 | 84 |
| 9 | x | 34.8 | 39.8* | — | 48 | 82 | 0.15 | 1.92 | 1.18 | 83 |
| 10 | ○ | 36.6 | 43.8 | 10 | 59 | 727 | <0.02 | <0.02 | 0.92 | 78 |
| 11 | ○ | 36.8 | 43.8 | 5 | 56 | 752 | " | " | 1.12 | 78 |
| 12 | ○ | 35.7 | 42.8 | 2 | 41 | 703 | " | " | 0.93 | 75 |
| 13 | x | 37.2 | 44.9 | — | — | — | — | — | — | 60 |
| 14 | x | 37.0 | 43.3 | — | — | — | — | — | — | 55 |
| 15 | x | 35.7 | 43.5 | — | — | — | — | — | — | 40 |
| 16 | ○ | 35.5 | 41.4 | — | — | — | <0.02 | — | — | 92 |
| 17 | ○ | 35.4 | 42.1 | — | — | — | " | — | — | 90 |
| 18 | ○ | 36.0 | 42.5 | — | — | — | " | — | — | 92 |
| 19 | ○ | 35.9 | 43.0 | — | — | — | " | — | — | 90 |
| 20 | ○ | 36.5 | 43.3 | 8 | 45 | 382 | " | <0.02 | 1.17 | 94 |
| 21 | ○ | 35.6 | 42.1 | — | — | — | " | — | — | 94 |
| 22 | ○ | 36.6 | 43.5 | — | — | — | " | — | — | 90 |
| 23 | ○ | 36.2 | 42.6 | — | — | — | <0.02 | — | — | 90 |
| 24 | ○ | 35.8 | 42.0 | 3 | 42 | 279 | " | <0.02 | 1.25 | 90 |
| 25 | ○ | 36.6 | 43.4 | — | — | — | " | — | — | 92 |
| 26 | x | 34.8 | 41.6 | — | — | — | 0.09 | 1.45 | — | 90 |
| 27 | x | 35.2 | 41.4 | — | — | — | 0.12 | 2.15 | — | 92 |
| 28 | x | 34.9 | 41.5 | — | — | — | 0.07 | 1.59 | — | 88 |
| 29 | x | 35.1 | 41.9 | — | — | — | 0.11 | 1.76 | — | 92 |
| 30 | x | 36.0 | 42.4 | — | — | — | 0.05 | 1.97 | — | 90 |
| 31 | ○ | 34.8 | 41.5 | 2 | 38 | 255 | <0.02 | — | 0.93 | 94 |
| 32 | ○ | 34.5 | 42.1 | — | — | — | " | — | — | 90 |
| 33 | ○ | 35.7 | 42.4 | — | — | — | " | — | — | 88 |
| 34 | ○ | 35.5 | 42.2 | — | — | — | " | — | — | 84 |
| 35 | ○ | 37.5 | 43.0 | — | — | — | " | — | — | 92 |
| 36 | ○ | 37.2 | 44.0 | 5 | 63 | 652 | " | — | 1.15 | 90 |
| 37 | ○ | 37.7 | 43.8 | — | — | — | " | — | — | 84 |
| 38 | ○ | 37.6 | 44.0 | — | — | — | " | — | — | 84 |
| 39 | ○ | 36.9 | 43.3 | 13 | 57 | 427 | " | — | 1.20 | 82 |
| 40 | ○ | 36.3 | 42.5 | — | — | — | " | 0.20 | 1.24 | 82 |
| 41 | x | 36.9 | 37.5* | 541 | 46 | 34 | 0.21 | 9.64 | 1.21 | 92 |
| 42 | x | 38.9 | 42.4 | 67 | 83 | 295 | <0.02 | 0.29 | 1.17 | 70 |
| 43 | x | 39.7 | 43.8 | 78 | 108 | 322 | " | 0.36 | 1.19 | 78 |
| 44 | x | 38.8 | 41.2 | 61 | 72 | 203 | 0.05 | 0.95 | 1.23 | 72 |

(Note)
—: Not determined.
*: Outside the range defined in the present invention.
1)○: Present Invention, x: Comparative.
2)PSI = Cr + 3.3Mo + 3Si
3)PREW = Cr + 3.3(Mo + 0.5W) + 16N

TABLE 3

| No. | | Tensile Properties @ RT T.S. (N/mm²) | Y.S. (N/mm²) | EL (%) | Tensile Properties @ 200° C. T.S. (N/mm²) | Y.S. (N/mm²) | EL (%) |
|---|---|---|---|---|---|---|---|
| 1 | ○ | 807 | 561 | 41 | 712 | 425 | 42 |
| 2 | ○ | 822 | 586 | 41 | 728 | 436 | 40 |
| 3 | ○ | 830 | 599 | 39 | 739 | 446 | 38 |
| 4 | ○ | 827 | 595 | 40 | 736 | 449 | 38 |
| 5 | ○ | 835 | 609 | 41 | 735 | 445 | 38 |
| 6 | ○ | 857 | 648 | 37 | 753 | 472 | 36 |
| 7 | ○ | 863 | 645 | 37 | 751 | 479 | 35 |
| 8 | x | 789 | 542 | 40 | 710 | 403 | 39 |

TABLE 3-continued

| No. | | Tensile Properties @ RT T.S. (N/mm²) | Y.S. (N/mm²) | EL (%) | Tensile Properties @ 200° C. T.S. (N/mm²) | Y.S. (N/mm²) | EL (%) |
|---|---|---|---|---|---|---|---|
| 9 | x | 791 | 556 | 40 | 707 | 408 | 38 |
| 10 | ○ | 833 | 587 | 40 | 730 | 435 | 38 |
| 11 | ○ | 829 | 592 | 37 | 731 | 430 | 37 |
| 12 | ○ | 830 | 591 | 35 | 734 | 429 | 32 |
| 20 | ○ | 825 | 590 | 40 | 735 | 439 | 38 |
| 24 | ○ | 807 | 565 | 40 | 729 | 428 | 40 |
| 31 | ○ | 810 | 559 | 38 | 725 | 424 | 38 |
| 36 | ○ | 806 | 557 | 39 | 731 | 425 | 39 |

TABLE 3-continued

| No. | | Tensile Properties @ RT T.S. (N/mm²) | Y.S. (N/mm²) | EL (%) | Tensile Properties @ 200° C. T.S. (N/mm²) | Y.S. (N/mm²) | EL (%) |
|---|---|---|---|---|---|---|---|
| 39 | ○ | 809 | 561 | 38 | 724 | 427 | 38 |
| 41 | x | 732 | 541 | 37 | 615 | 371 | 37 |
| 42 | x | 813 | 583 | 40 | 718 | 425 | 39 |
| 43 | x | 831 | 596 | 38 | 725 | 430 | 35 |
| 44 | x | 780 | 551 | 40 | 627 | 381 | 38 |

Note
○: Present Invention,
x: Comparative

In the thermal structural stability test in which aging treatment of 900° C.×10 minutes was applied so as to cause precipitation of σ- and similar phases, even the W-containing test steels according to the present invention suffered hardening to some extent. However, because the Cr and Mo contents of these steels which contributed to the PSI values were decreased due to the addition of W, the values for ΔHv of the steels of the present invention were on the order of about 50 and were significantly smaller than the values of the conventional steels (No. 42–44), which were on the order of about 80.

In the same test in which the aging treatment was conducted at 850° C., the temperature at which precipitation of σ- and similar phases is initiated, the steels of the present invention did not suffer any significant hardening (ΔHv<10 in most cases), while the conventional steels showed a clear increase in hardness (ΔHv>60).

From these results, it is apparent that the duplex stainless steels of the present invention have significantly improved thermal structural stability with extremely slow precipitation of hard and brittle intermetallic compounds (σ- and similar phases) compared to the conventional steels which correspond to the prior art super duplex stainless steels.

Regarding resistance to pitting corrosion, comparative steels having relatively small PREW values (Nos. 8, 9, and 41) showed an extremely low pitting potential and readily developed pitting corrosion in a ferric chloride solution at 50° C. with a corrosion rate of 0.1–0.2 g/m²-hr.

The conventional steels (Nos. 42–44) having values for PREW (or PRE) above 40 and corresponding to the prior art super duplex stainless steels exhibited excellent corrosion resistance and developed no appreciable pitting corrosion in a ferric chloride solution at 50° C. These steels also showed a high pitting potential in a high-temperature, high-$Cl^-$ ion concentration environment and therefore had excellent corrosion resistance required for sea water-resistant materials. Similarly, the steels of the present invention exhibited excellent resistance to pitting corrosion comparable to the conventional steels.

In the more severe pitting corrosion test in a ferric chloride solution at 75° C., pitting corrosion occurred in even the conventional steels. In contrast, when W was added for improvement in corrosion resistance according to the present invention, those steels of the present invention having a relatively high W content of greater than 2.0% (e.g., Nos. 4–7) could resist pitting corrosion under such severe conditions.

Thus, in accordance with the present invention, since the high value for PREW of at least 40 is attained with retarding precipitation of σ- and similar phases, the resistance to pitting corrosion can be greatly improved to a degree comparable to or even superior to prior art super duplex stainless steels.

Steels Nos. 26–30 are comparative steels in which the contents of the second group elements (Ca, Mg. etc.) added to improve the hot workability were excessively high. In these steels, the resistance to pitting corrosion was deteriorated due to the formation of inclusions in an increased amount although the values for PREW were sufficiently high.

From the results on corrosion resistance in acid shown in Table 2 in terms of corrosion rate in sulfuric acid, it can be seen that the addition of Cu is effective for improvement in corrosion resistance in a non-oxidizing or reducing acid environment such as $H_2SO_4$. The results on pitting potential indicate that the addition of V is also effective. However, hot workability was remarkably degraded in Steels Nos. 13–15 which are comparative steels having an excessively high Cu or V content.

Hot workability was evaluated in terms of reduction in area in a high-speed tensile test at a temperature of 1000° C., at which adverse effects of S and precipitated intermetallic compounds on hot workability become significant. As can be seen from Table 2, the hot workability of the steels of the present invention was satisfactory giving a reduction in area of at least 74%. Steels Nos. 16–25 which contained at least one second group element in order to attain further improvement in hot workability showed an extremely high reduction in area of at least 90%.

From Table 3, which indicates tensile properties at room temperature and 200° C., it can be seen that the steels of the present invention have excellent mechanical strength since both the 0.2% yield strength (Y.S.) and tensile strength (T.S.) of these steels were comparable to those of the prior art super duplex stainless steels (Nos. 42–44) irrespective of temperature (room temperature or 200° C.). Particularly, Steels Nos. 5 to 7 which contained 3% or more W showed an extremely high yield strength of 600 N/mm² at room temperature. In spite of such high strength, the steels of the present invention showed a high elongation (El), indicating that their ductility was satisfactory.

FIG. 1 is a graph in which the values for PREW of representative steels tested in this example are plotted against pitting potential of these steels measured in a 20% NaCl solution at 80° C. The numbers in this figure correspond to the Steel Numbers. The larger the PREW value, the higher the pitting potential. Particularly those steels having a relatively high W content of greater than 2.0% (Steels Nos. 4–7, 10–12, etc.) showed a tendency to have an increased pitting potential over the average relationship between PREW value and pitting corrosion.

It will be appreciated by those skilled in the art that numerous variations and modifications may be made to the invention as described above with respect to specific embodiments without departing from the spirit or scope of the invention as broadly described.

What is claimed is:

1. A high-strength duplex stainless steel with improved corrosion resistance, which has a chemical composition consisting essentially, on a weight basis, of:

| | |
|---|---|
| C: 0.03% or less, | Si: 1.0% or less, |
| Mn: 1.5% or less, | P: 0.040% or less, |
| S: 0.008% or less, | sol.Al: 0.040% or less, |

-continued

| | |
|---|---|
| Ni: 5.0–9.0%, | Cr: 23.0–27.0%, |
| Mo: 2.0–4.0%, | N: 0.24–0.32%, |
| W: greater than 1.5% and at most 5.0%, | |

at least one element selected from the group consisting of Cu:0–2.0% and V:0–1.5%, at least one element selected from the group consisting of Ca:0–0.02%, Mg:0–0.02%, B:0–0.02%, and one or more rare earth metals: 0–0.02% in total, and a balance of Fe and incidental impurities, said chemical composition having a value of at least 40 for PREW defined by the following formula (a):

$$PREW=[\%Cr]+3.3([\%Mo]+0.5[\%W])+16[\%N] \quad (a)$$

where the percent of each element is by weight.

2. The high-strength duplex stainless steel of claim 1, which contains at least one element selected from the group consisting of Cu: 0.02–2.0% and V: 0.05–1.5%.

3. The high-strength duplex stainless steel of claim 1, which contains at least one element selected from the group consisting of Ca: 0.02% or less, Mg: 0.02% or less, B: 0.02% or less, and one or more rare earth metals: 0.2% or less in total, the Ca, Mg, B and/or rare earth metals being present in an amount of at least %S+½% O.

4. The high-strength duplex stainless steel of claim 1, which contains at least one element selected from the group consisting of Cu: 0.02–2.0% and V: 0.05–1.05% and at least one element selected from the group consisting of Ca: 0.02% or less, Mg: 0.02% or less, B: 0.02% or less, and one or more rare earth metals 0.2% or less in total, the Ca, Mg, B and/or rare earth meatls being present in an amount of at least %S+½% O.

5. The high-strength duplex stainless steel of claim 1, wherein the Si content is at most 0.5%.

6. The high-strength duplex stainless steel of claim 1, wherein the S content is at most 0.005%.

7. The high-strength duplex stainless steel of claim 1, wherein PREW is at least 41.2.

8. A high-strength duplex stainless steel with improved corrosion resistance, which has a chemical composition consisting essentially, on a weight basis, of:

| | |
|---|---|
| C: 0.03% or less, | Si: 1.0% or less, |
| Mn: 1.5% or less, | P: 0.040% or less, |
| S: 0.008% or less, | sol.Al: 0.040% or less, |
| Ni: 5.0–9.0% | Cr: 23.0–27.0% |
| Mo: 2.0–4.0% | N: 0.24–0.32%, |
| W: greater than 2.0% and at most 5.0%, | |

at least one element selected from the group consisting of Cu: 0–2.0% and V: 0–1.5%, at least one element selected from the group consisting of Ca: 0–0.02%, Mg: 0–0.02%, B: 0–0.02%, and one or more rare earth meatls: 0–0.2% in total, and a balance of Fe and incidental impurities, said chemical composition have a value of at least 40 for PREW defined by the following formula (a):

$$PREW=[\%Cr]+3.3([\%Mo]+0.5[\%W])+16[\%N] \quad (a)$$

where the percent of each element is by weight.

* * * * *

UNITED STATES PATENT AND TRADEMARK OFFICE

CERTIFICATE OF CORRECTION

PATENT NO. : 5,298,093

DATED : March 29, 1994

INVENTOR(S) : Hiroshi OKAMOTO

It is certified that error appears in the above-identified patent and that said Letters Patent is hereby corrected as shown below:

On title page, item [30] "2-294016" should read --3-294016--.

Signed and Sealed this

Sixteenth Day of August, 1994

Bruce Lehman

*Attest:*

BRUCE LEHMAN

*Attesting Officer*

*Commissioner of Patents and Trademarks*